United States Patent [19]

Hoffman et al.

[11] 4,274,692

[45] Jun. 23, 1981

[54] TORSIONALLY FLEXIBLE CONNECTOR COVER

[75] Inventors: Ernest G. Hoffman, Middlefield; Michael J. D'Amato, North Haven, both of Conn.

[73] Assignee: Harvey Hubbell Incorporated, Orange, Conn.

[21] Appl. No.: 76,793

[22] Filed: Sep. 18, 1979

[51] Int. Cl.[3] ..... H01R 13/52

[52] U.S. Cl. ..... 339/60 M; 339/63 M; 339/88 R; 339/94 R

[58] Field of Search ..... 339/60, 62, 63, 88, 339/94 R, 94 C, 94 M, 213 R, 213 T

[56] References Cited

U.S. PATENT DOCUMENTS

| | | | |
|---|---|---|---|
| 2,567,727 | 9/1951 | Quackenbush | 339/94 R |
| 2,755,449 | 7/1956 | Anderson | 339/94 R |
| 3,120,987 | 2/1964 | Degnan et al. | 339/60 M |
| 3,157,450 | 11/1964 | Harrison, Sr. et al. | 339/94 |
| 3,167,374 | 1/1965 | Healy | 339/60 R |
| 3,449,706 | 6/1969 | Carissimi | 339/94 |
| 3,792,415 | 2/1974 | Fuller | 339/60 R |
| 4,063,793 | 12/1977 | Judd | 339/60 R |

FOREIGN PATENT DOCUMENTS

| | | | |
|---|---|---|---|
| 800037 | 8/1958 | United Kingdom | 339/94 R |

*Primary Examiner*—John McQuade
*Attorney, Agent, or Firm*—Jerry M. Presson

[57] ABSTRACT

A protective cover for an electrical connector capable of torsional flexibility and adapted for use in combination with an electrical connector having a rotatable sleeve for actuating a locking pin to lock the connector's blades. The cover is a unitary elastomeric body comprising a clamping assembly for securing to the connector cable, a gripping sleeve for engaging the rotatable sleeve on the connector, and a torsionally flexible portion joining the clamping assembly and gripping sleeve. The torsionally flexible portion includes an annular series of radial pleats and a thin-walled tubular portion extending from the pleats.

5 Claims, 6 Drawing Figures

TORSIONALLY FLEXIBLE CONNECTOR COVER

FIELD OF THE INVENTION

The present invention relates to a protective cover for an electrical connector, and more particularly relates to such a cover which is torsionally flexible and adapted to be used in combination with an electrical connector having a rotatable actuating sleeve for manipulating connector locking means.

BACKGROUND OF THE INVENTION

In the art relating to electrical connectors having a plurality of blades, usually three or more, it is well known to provide a water proof cover for protecting the connector. Examples of such are disclosed in U.S. Pat. No. 3,167,374, issued to J. F. Healy, U.S. Pat. No. 3,449,706, issued to V. L. Carissimi, and U.S. Pat. No. 3,792,415, issued to A. W. Fuller. As disclosed in these patents, the protective cover is formed from a unitary body of elastomeric material. Each of these covers merely surrounds a portion of the connector so as to protect it from the elements. In U.S. Pat. No. 3,449,706, the electrical connector blade holder, blades and electrical cable are received within the cover and are rotated relative thereto to make the connection. In U.S. Pat. Nos. 3,167,374 and 3,792,415, the cover surrounds the cable as well as a portion of the blade holder and is carried by that combination. In order to make the connection in these last two mentioned patents, the cover and the blade holder are rotated together.

These types of covers are effective for the types of connectors disclosed in these patents; however, these types of connectors have a specific drawback which requires a new type of connector and also a corresponding new type of protective cover. Specifically, these types of electrical connectors tend to come apart under certain conditions of severe vibration or the inadvertent twisting of the cable in an uncoupling direction. In order to solve this problem, a new type of electrical connector has been invented which provides a retractable locking pin adjacent one of the blades which fits into the blade receiving aperture to which connection is made. In order to retract the locking pin for unlocking purposes, the electrical connector has a rotatable actuating sleeve. A particularly advantageous form of this invention is disclosed in co-pending U.S. patent application entitled LOCKING PLUG, Ser. No. 076,792, filed Sept. 18, 1979 and now U.S. Pat. No. 4,241,969, in the names of Michael J. D'Amato and Frank C. Jaconette and assigned to the assignee of the present application. The apparatus disclosed in that application, which is hereby incorporated by reference, basically provides for a blade holder, a plurality of blades, an electrical cable connected to the blades, a generally cylindrical actuating sleeve rotatably coupled to the blade holder, a cable clamp coupled to the blade holder and clamped to the cable, and a retractable locking pin slidably received in the blade holder and protruding adjacent the side of one of the blades. The retractable locking pin is spring loaded so that, on insertion of the blades into the blade receiving apertures in a mating connector half, the locking pin is pushed into the blade holder and upon full reception of the blades in the apertures and rotation thereof the locking pin is biased into one of the apertures next to the blade. This fills the aperture and prevents rotation of the blade and therefore inadvertent removal. In order to withdraw the locking pin, the actuating sleeve is rotated relative to the blade holder which draws the locking pin into the blade holder. Continued rotation of the actuating sleeve moves the blade into a position in which they may be pulled out of the apertures.

In order to provide an effective weather proof cover for this new electrical connector or for any locking connector having a rotatable actuating sleeve, the cover must be torsionally flexible about the longitudinal axis of the blade holder and the electrical cable so as to absorb rotation thereof upon gripping and rotation of the actuating sleeve. In addition, this cover must be effective in all types of weather in both low and high temperatures. None of the three patents set forth above provide for such a required torsional flexibility since they are not constructed to deal with this type of movement. Similarly, U.S. Pat. No. 3,157,450, issued to W. B. Harrison, Sr. et al., while disclosing an electrical cable connector with a cover and a clamping assembly, fails to disclose the concept of providing significant torsional flexibility.

SUMMARY OF THE INVENTION

Accordingly, it is an object of the present invention to provide a weather proof protective cover for an electrical connector in which a portion of the connector is rotatable relative to another portion.

Another object of the present invention is to provide a weather proof protective cover for an electrical connector portion which cover is torsionally flexible about the longitudinal axis of the connector.

Another object of the present invention is to provide a weather proof protective cover for an electrical connector which is capable of being used in all types of weather and in high or low temperatures.

Another object of the present invention is to provide a weather proof protective cover for an electrical connector which is light in weight, easily manufactured and will not fail when subjected to repeated twisting.

The foregoing objects are basically attained by providing a protective cover of elastomeric material for use in combination with an electrical connector portion of the type having a plurality of electrically conductive connector elements, a non-conductive holder for supporting the connector elements for cooperative engagement with connector elements in a mating connector portion, means for releasably locking the mating connector portions in their engaged relationship, and a generally cylindrical rotatable actuating sleeve for operating the means for locking, the cover comprising a gripping sleeve receivable over and frictionally engagable with the actuation sleeve; a clamping assembly rigidly securable to the electrical cable; and a torsionally flexible portion connected between and joining the gripping sleeve and the clamping assembly, permitting relative rotation between the sleeve and the clamping assembly.

In particular, the cover is formed of a unitary body of elastomeric material and the torsionally flexible portion includes an annular series of radial pleats and a thin-walled tubular portion extending from the pleats.

By so providing such a protective cover, the required torsional rotation of the electrical connector in combination with the cover is easily absorbed by the cover without breaking its weather proof encapsulation of the electrical connector. Moreover, the torsional mobility of the cover is highly increased by the pleated configuration so that the cover can easily be twisted as required to unlock the locking pin on the electrical connector.

Other objects, advantages and salient features of the present invention will become apparent from the following detailed description which, taken in conjunction with the annexed drawings, discloses a preferred embodiment of the present invention.

DESCRIPTION OF THE DRAWINGS

Referring now to the drawings which form a part of this original disclosure.

DETAILED DESCRIPTION OF THE INVENTION

Figure 2:
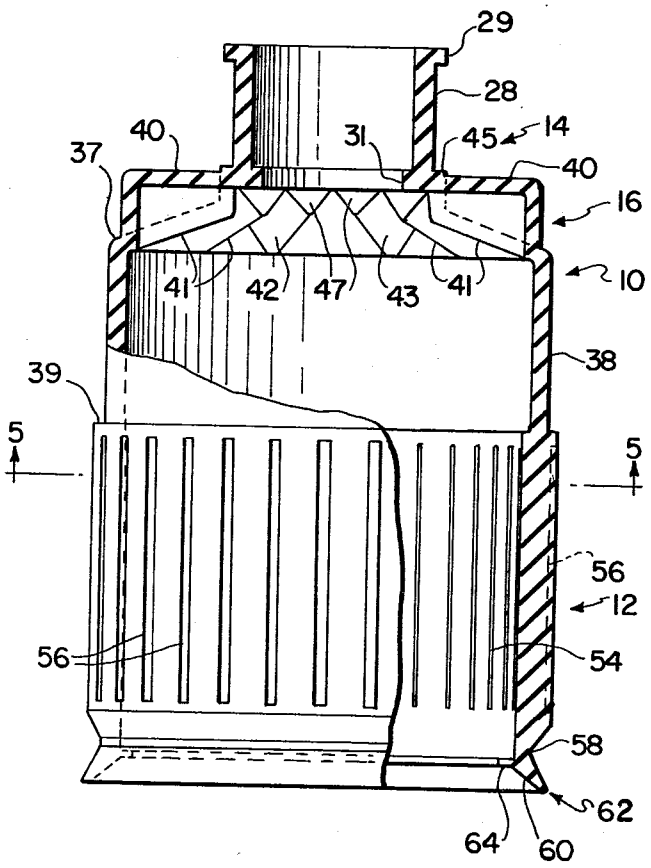
FIG. 2 is a side elevational view with parts cut away showing the protective cover in accordance with the present invention as seen in FIG. 1 except the electrical connector used therewith is not shown.
Figure 1:
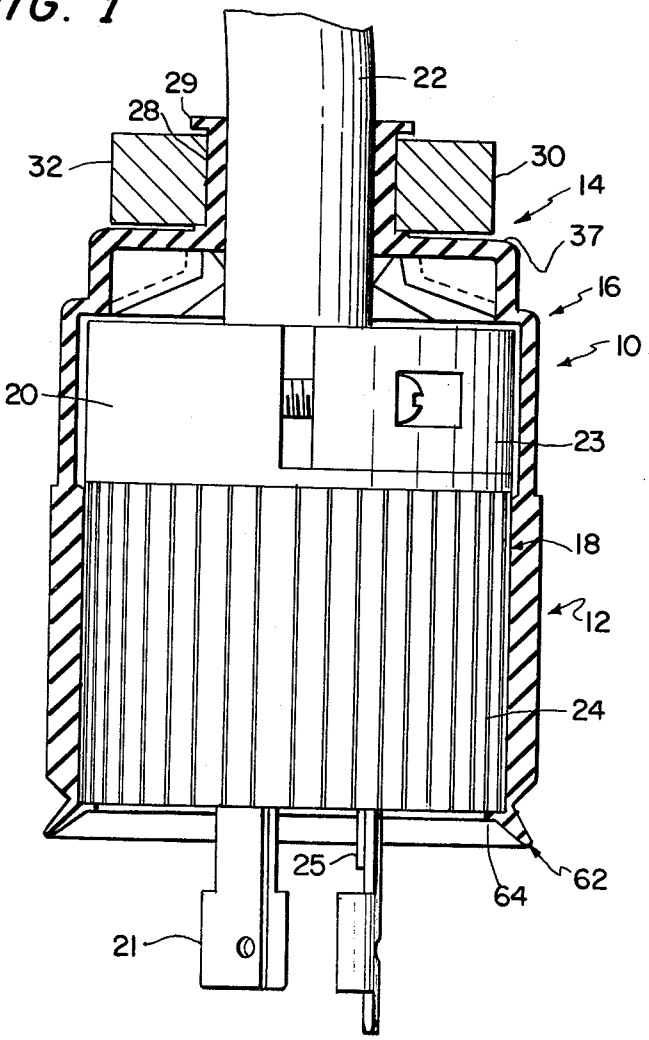
FIG. 1 is a side elevational view in central longitudinal section of the protective cover in accordance with the present invention receiving therein an electrical connector having a rotatable actuating sleeve.

Referring now to the drawings in further detail, the cover 10 of the present invention as seen in FIGS. 1 and 2 is comprised of a unitary body formed of elastomeric material, such as rubber, and includes a gripping sleeve 12, a clamping assembly 14 and a torsionally flexible portion 16.

As seen in FIG. 1, the cover 10 is associated with an covers an electrical connector 18, which is more fully disclosed in the co-pending application described above. For the purposes of this application, the electrical connector 18 can be described as including a blade holder 20, a plurality of blades 21 extending therefrom, an electrical cable 22 electrically coupled to the blades, a cable clamp 23 coupled to the blade holder 20 and clamping the cable 22 thereto, an actuating, generally cylindrical sleeve 24 rotatably supported on the blade holder 20 and a retractable locking pin 25 which is adjacent one of the blades 21 and which can be retracted into the blade holder 20 by means of rotation of the actuating sleeve 24.

Figure 3:
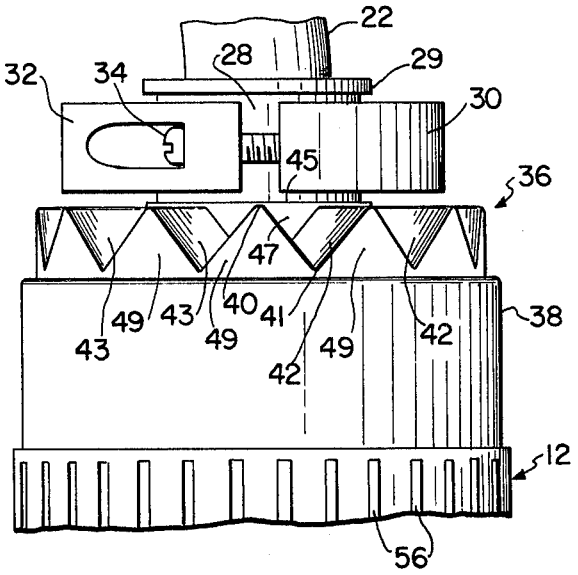
FIG. 3 is a fragmentary side elevational view of the protective cover and electrical connector shown in FIG. 1.

As is evident from FIGS. 1 and 3, the electrical cable 22 is received in the clamping assembly 14 of the cover 10 and is rigidly secured thereto, the actuating sleeve 24 of the connector is received in and frictionally engagable with the gripping sleeve 12 of the cover, and the blades 21 protrude outwardly beyond the gripping sleeve 12. In order to rotate the actuating sleeve 24 of the connector with the blades received in their apertures, the operator grasps the outside of the gripping sleeve 12 and rotates that sleeve and the actuating sleeve inside. Since the clamping assembly 14 is rigidly secured to the cable 22, the torsionally flexible portion 16 absorbs the relative twisting motion between the clamping assembly 14 and the gripping sleeve 12.

Referring to the cover 10 in more detail, as seen in FIGS. 2–6, the clamping assembly 14 comprises a clamping sleeve 28 in the form of a cylindrical tube having an exterior flange 29 at the top thereof, an interior flange 31 at the bottom thereof, and two C-clamp members 30 and 32, seen in FIGS. 1 and 3, which have suitable bores therein for the reception of two clamping screws 34, only one of which is shown in FIG. 3. As seen therein, the clamp members 30 and 32 are received on the outside of clamping sleeve 28 and when tightened clamp the cable 22 against the clamping sleeve 28 so that they are rigidly secured against relative rotation. In the case where the electrical cable is significantly smaller than the central bore of sleeve 28, a suitable elastomeric bushing may be interposed between the cable and the sleeve.

Extending below the clamping assembly 14 and integrally formed therewith is the torsionally flexible portion 16 which comprises an annular series of radial pleats 36 and a tubular portion 38 extending downwardly and offset at shoulder 37 from the outer periphery of the series of pleats. As seen in FIGS. 1 and 2, the tubular portion 38 has a cylindrical wall having a thickness less than the thickness of the cylindrical wall of the gripping sleeve 12. Portion 38 extends into the sleeve defining outwardly extending shoulder 39 with the thicker sleeve 12.

Figure 4:
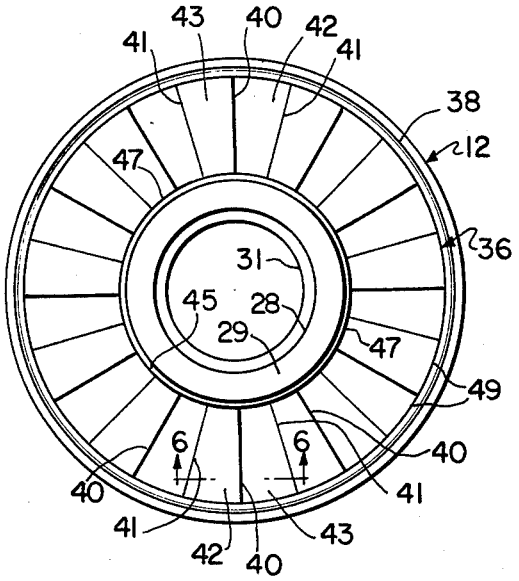
FIG. 4 is a top plan view of the protective cover shown in FIG. 2.
Figure 5:
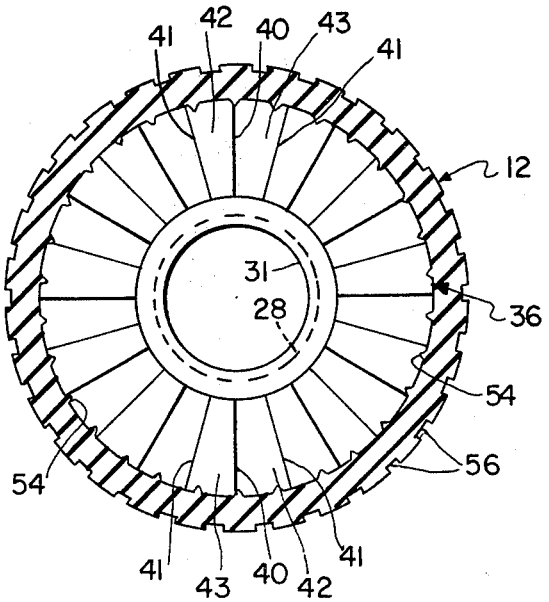
FIG. 5 is a bottom plan view in section taken along lines 5—5 in FIG. 2 showing the inside of the protective cover.
Figure 6:
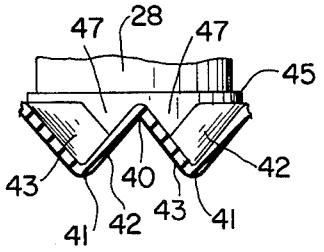
FIG. 6 is a fragmentary elevational view in section taken along lines 6—6 in FIG. 4 showing the cross sectional configuration of the radial pleats in the protective cover.

The series of pleats 36 extend radially outward from the bottom of the clamping sleeve 28 and have a substantially inverted V-shaped cross section as seen in FIG. 6. In plan view, as seen in FIGS. 4 and 5, each pleat has a substantially trapezoidal shape. As seen in FIGS. 2–5, there is a plurality of evenly spaced pleats, 12 being shown, having peaks 40 and valleys 41. The peaks are all substantially contained in an annular plane, as best seen in FIG. 3; and the valleys are each substantially contained in a truncated conical surface as best seen in FIG. 2. The annular plane is perpendicular to the longitudinal axis of the sleeve 28, and thus perpendicular to the axis of rotation of the actuating sleeve 18 and gripping sleeve 12.

Each pleat is formed from a left hand leg 42 and a right hand leg 43, each leg having substantially planar outer surfaces and a substantially rectangular cross-section. These legs intersect at the tops thereof at the peaks 40 in a substantially 90° angle. At the bottoms, adjacent pleats are connected at the valleys 41 formed from intersection of adjacent right hand legs 43 and left hand legs 42 at substantially a 90° angle.

An outwardly extending annular ridge 45, seen in FIGS. 1–4 and 6, is formed adjacent the bottom of sleeve 28 and the inner periphery of the series of pleats 36.

Below the ridge 45, a series of inverted triangular inner faces 47 are formed, as seen in FIGS. 2, 3, and 6, which are located between adjacent pleats.

Similarly, a series of triangular outer faces 49 are formed, as seen in FIGS. 3 and 4, between the outer peripheries of legs 42 and 43 for each pleat, which faces extend into tubular portion 38 at shoulder 37.

As is evident, during rotation of the gripping sleeve 12 relative to the clamping assembly 14, the series of pleats or corrugations tend to be compressed to thereby absorb the twisting or torsional movement therebetween.

As best seen in FIGS. 1–3, the tubular portion 38 extends downwardly from the outer periphery of the series of pleats 36 into the gripping sleeve 12. As mentioned above, the cylindrical wall of the gripping sleeve has a thickness greater than the thickness of tubular portion 38. Advantageously, sleeve 12 can be about three times thicker than portion 38. In addition, the gripping sleeve has on the interior surface thereof a plurality of ribs 54, as seen in FIGS. 2 and 5, which extend longitudinally in spaced relationship. These ribs aid in the frictional engagement of the gripping sleeve 12 with the actuating sleeve 24 of the connector 18. In addition, the exterior surface of gripping sleeve 12 has a plurality of longitudinally extending slots 56, as seen in FIGS. 2, 3 and 5, to increase the friction on the outside of that sleeve, which is to be grasped by the operator.

As seen best in FIGS. 1 and 2, extending near the bottom of the gripping sleeve 12 is an annular notch 58 on the outside thereof which defines with an interior annular bevel 60 a flaring lip 62 which acts as a seal for the cover 10. On the inside and at the top of the lip 62 is an annular rim 64 which receives the bottom of the combined blade holder 20 and actuating sleeve 24, as seen in FIG. 1.

OPERATION

As seen in FIG. 1, the cover 10 completely covers the electrical connector 18 and provides significant weather-proof protection thereof. In order to place the cover 10 over the connector 18, the cover 10 is slipped onto the electrical cable 22 through clamping sleeve 28 and is moved somewhat along the cable. Then, the electrical connector is fully assembled and clamped to cable 22, at which time the cover 10 is slid down over the connector 18 so that the top of blade holder 20 and clamp 23 abut the bottom of pleats 36 and so that the bottom of the blade holder 20 and the actuating sleeve 24 abut rim 64. At this time, the two C-clamps 30 and 32 are tightened so as to rigidly secure the clamping sleeve 28 to the cable 22.

The combined electrical connector 18 and cover 10 are now ready to be used. To do this, they are manipulated so that blades 21 are first placed into suitable blade receiving apertures and then these blades with the connector 18 are rotated to lock the blades therein. During this first longitudinal movement the retractable pin 25 is biased into the blade holder 20 and then springs back into the blade receiving aperture upon rotation of the blades. In this position, the blades are locked into the blade receiving apertures since the retractable locking pin resides in one blade receiving aperture between an edge of the aperture and the blade received therein.

In order to unlock the locking pin and retract the electrical connector 18, the operator grasps the outside of the gripping sleeve 12 and rotates the gripping sleeve 12 and the actuating sleeve 24 relative to the blade holder 24. This retracts the locking pin 25. Continued rotation moves the blades 21 into a position in which they can be longitudinally pulled from the blade receiving apertures.

During such initial and continued rotation, the cover 10 experiences significant twisting; however, this is absorbed by the torsionally flexible portion 16. In particular, since the clamping assembly 14 is rigidly secured to the cable 22, rotation of the gripping sleeve 12 results in a significant twisting of the torsionally flexible portion 16. This is absorbed by relative compression of the series of radial pleats 36 as well as twisting of the thin-walled tubular portion 38. This type of torsional force is consistently absorbed by torsionally flexible portion 16 due to its construction, even in low and high temperatures and in varied weather conditions.

While one advantageous embodiment has been chosen to illustrate the invention, it will be understood by those skilled in the art that various changes and modifications can be made therein without departing from the scope of the invention as defined in the appended claims.

What is claimed is:

1. A protective cover of elastomeric material for use in combination with an electrical connector portion securable to an electrical cable, the connector portion of the type having a plurality of electrically conductive connector elements, a non-conductive holder for supporting the connector elements for cooperative engagement with connector elements in a mating connector portion, means for releasably locking the mating connector portions in their engaged relationship, and a generally cylindrical sleeve rotatable about the longitudinal axis thereof for operating the means for locking, the cover comprising:

a gripping sleeve receivable over and frictionally engagable with the surface of said rotatable member;

a cable clamping portion on the cover; and a torsionally flexible portion comprising a series of resilient pleats connected between and joining said gripping sleeve and said cable clamping portion, permitting relative rotation about said longitudinal axis of said member between said member and said cable clamping portion, each of said pleats having a substantially inverted V-shaped cross section and the apices of said pleats extending radially from the longitudinal axis of said sleeve.

2. A protective cover according to claim 1, wherein said gripping sleeve comprises a cylindrical tube, and said torsionally flexible portion further comprises a tubular portion extending between said pleats and said gripping sleeve, said tubular portion having a wall thickness less than the wall thickness of said gripping sleeve.

3. A protective cover according to claim 1, wherein the apices of said pleats are each substantially contained in a plane substantially perpendicular to said longitudinal axis of said sleeve.

4. A protective cover according to claim 3, wherein the bottoms of said pleats are each substantially contained in a truncated conical surface.

5. A protective cover according to claim 1, wherein each of said pleats is trapezoidal in plan view.

* * * * *